United States Patent [19]

Pfaehler

[11] 4,109,981

[45] Aug. 29, 1978

[54] CABINET-LIKE FURNITURE UNIT OF CELLULAR STRUCTURE

[76] Inventor: Josephine Pfaehler, Frauenstrasse 9–11, 7900 Ulm, Fed. Rep. of Germany

[21] Appl. No.: 740,796

[22] Filed: Nov. 11, 1976

[51] Int. Cl.[2] ..... A47B 87/00

[52] U.S. Cl. ..... 312/107; 312/199; 312/140; 52/716; 16/124

[58] Field of Search ..... 312/107, 140, 140.4, 312/140.3, 138, 199, 304, 204; 52/716; 16/124

[56] References Cited

U.S. PATENT DOCUMENTS

| | | | |
|---|---|---|---|
| 1,870,534 | 8/1932 | Skoogh | 312/140 |
| 2,118,213 | 5/1938 | Malott | 312/140 |
| 2,705,820 | 4/1955 | Torrence | 52/716 |
| 3,107,389 | 10/1963 | Engelbrecht | 16/124 |
| 3,286,422 | 11/1966 | Pangerl | 52/716 |
| 3,287,867 | 11/1966 | Aton | 52/716 |
| 3,353,884 | 11/1967 | Chaffee et al. | 312/199 |
| 3,419,933 | 1/1969 | Gossen | 312/138 R |
| 3,582,170 | 6/1971 | Schaeffer | 312/140.4 |
| 3,697,363 | 10/1972 | Martinez | 312/204 |
| 3,868,804 | 3/1975 | Tantlinger | 52/716 |

FOREIGN PATENT DOCUMENTS

| | | | |
|---|---|---|---|
| 2,219,431 | 10/1973 | Fed. Rep. of Germany | 52/716 |
| 1,065,714 | 5/1956 | Fed. Rep. of Germany | 312/140 |

*Primary Examiner*—Paul R. Gilliam
*Assistant Examiner*—Victor N. Sakran
*Attorney, Agent, or Firm*—Baldwin, Egan, Walling & Fetzer

[57] ABSTRACT

A cabinet-like furniture unit of cellular structure having generally large area door arrangements for closing the open fronts of the cells; handling ledges or strips are mounted at the edges of the doors, with finger grooves provided in the outer surfaces of each of the handling ledges opening in a direction generally parallel to the main exterior surface of the respective door, and with profile bands of generally T-shaped transverse cross section sheathing the front edges of the cell walls; the handling ledges and profile bands are arranged in such manner that in the closed condition of the doors, the inner longitudinal edge of the outer surface of the handling ledge is in close proximity to the adjacent edge of the cross bar of the profile band, whereby, as viewed from the front, the handling ledge and associated profile band form a homogeneous whole. A novel profile band comprising two separate parts is also disclosed.

7 Claims, 13 Drawing Figures

CABINET-LIKE FURNITURE UNIT OF CELLULAR STRUCTURE

This invention relates to a cabinet-like furniture unit of cellular structure; the term "furniture unit" is intended to include cabinets, chests, sideboards, and the like. The invention is intended to relate to furniture units in which front edges of the sidewalls of the cells are open to an observer's view, as opposed to pieces of furniture in which these front edges are covered by the front panes of the piece of furniture and especially by the doors in the closed state thereof.

It has been known to design cabinet-like furniture units of cellular structure with multiple sliding doors, e.g., double sliding doors, which doors are roller-suspended so as to be slidable one in front of the other.

From the West German Offenlegungsschriften (DOS) Nos. 2,324,120 and 2,520,476 in the name of the applicant it has been known to provide at the longitudinal edges of sliding and revolving doors, edge bandings with finger grooves forming convenient handling means for opening and closing the doors. Further, these edge bandings with finger grooves permit of being integrated into the outer appearance of the piece of furniture in a harmonious way as regards taste, and furthermore these edge bandings with finger grooves may be designed so as to be easily detachable, thus forming retaining means for interchangeable ornamental or decorative panels forming the front faces of the doors.

From the British patent specification No. 814,655 it has been known in the art of furniture making to provide the front edges of walls and built-in panels with profiled bands of T-shaped cross-section made of plastic material or the like, the web portion of each band being inserted into a groove of the wall or the panel and secured therein, e.g., by a crossbolt, thus forming both an attractive cover and an effective protection of the front edge.

It is an object of this invention to design a cabinet-like furniture unit of cellular structure in such a manner that an aesthetically satisfying transition from each cell to the next is achieved.

It is a further object of the invention to provide a cabinet-like furniture unit of cellular structure, in which both a revolving or pivotal door and a sliding door are arranged harmoniously, there being no necessity to provide more than only one cell sidewall between the revolving and the sliding door, said cell sidewall being visible from the front.

It is still another object of the invention to provide a cabinet-like furniture unit of cellular structure, which comprises a rear panel wall secured in a simple and aesthetically satisfying manner to the furniture unit.

It is further object of the invention to provide a front-edge profiled band for covering the visible front edges of the cell partitions of a cabinet-like furniture unit of cellular structure.

These objects are attained according to the invention by a cabinet-like furniture unit of cellular structure, comprising a plurality of large-area door arrangements covering the open cell faces, the doors of said door arrangements including marginal ledges designed as handling bandings or handling ledges, the finger grooves of which open in a direction parallel to the open cell face and extend away from the respective door; in which the front edges of the cell walls separating the furniture cells from one another are covered by profiled bands having substantially T-shaped cross-section, said profiled bands being inserted with their web portions into longitudinal grooves of said front edges, and in which in the closed condition of the doors each handling banding is disposed with the inner longitudinal edge of its surface including said finger groove in such close proximity to one of the longitudinal edges of the crossbar of each adjacent front-edge profiled band that, viewed from the front, said handling banding and said front-edge profiled band form a homogeneous whole.

Further details and advantages of the invention will become apparent from the following description of the embodiments of the invention with reference to the accompanying drawings, in which.

Figure 8:
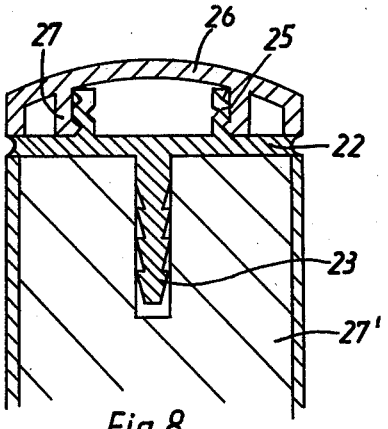
FIGS. 8 and 9 are cross-sectional views of profiled bands mounted on the front edge of a cell partition of the furniture unit according to the invention, in which the bottom strip of FIG. 7 is employed.
Figure 9:
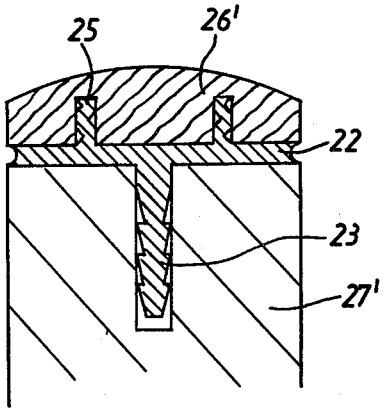
Figure 10:
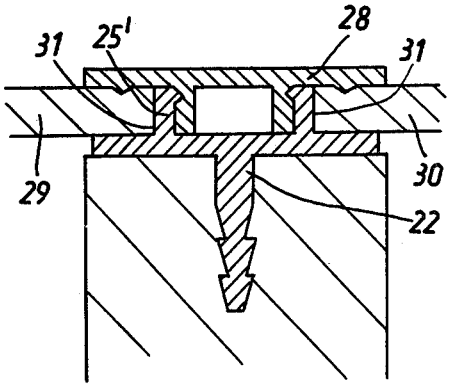
Figure 11:
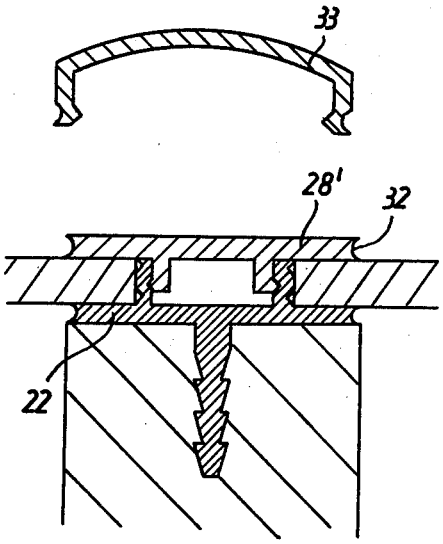
Figure 12:
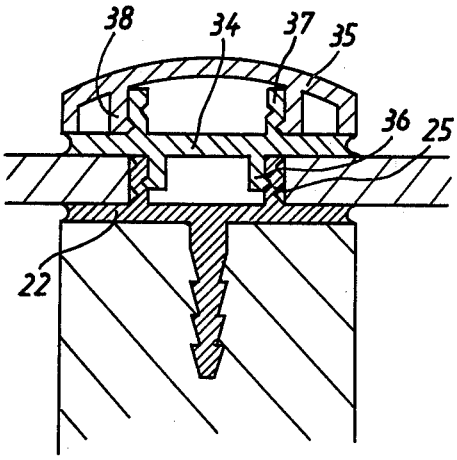
Figure 13:
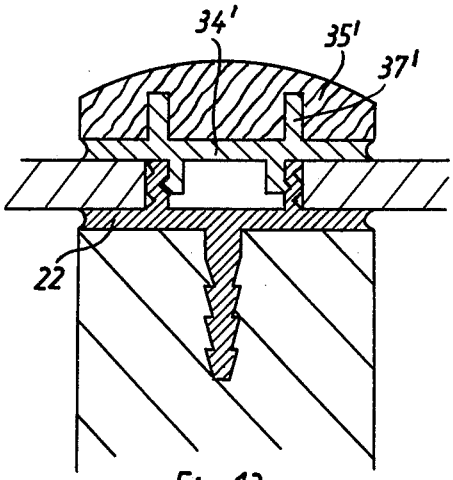

FIGS. 10 and 11 are cross-sectional views similar to those of FIGS. 8 and 9, in which however the profiled bands for the front edges serve the purpose of retaining panels; and FIGS. 12 and 13 are cross-sectional views similar to those of FIGS. 10 and 11, in which however the profiled bands for the front edges are tripartite.

Figure 1:
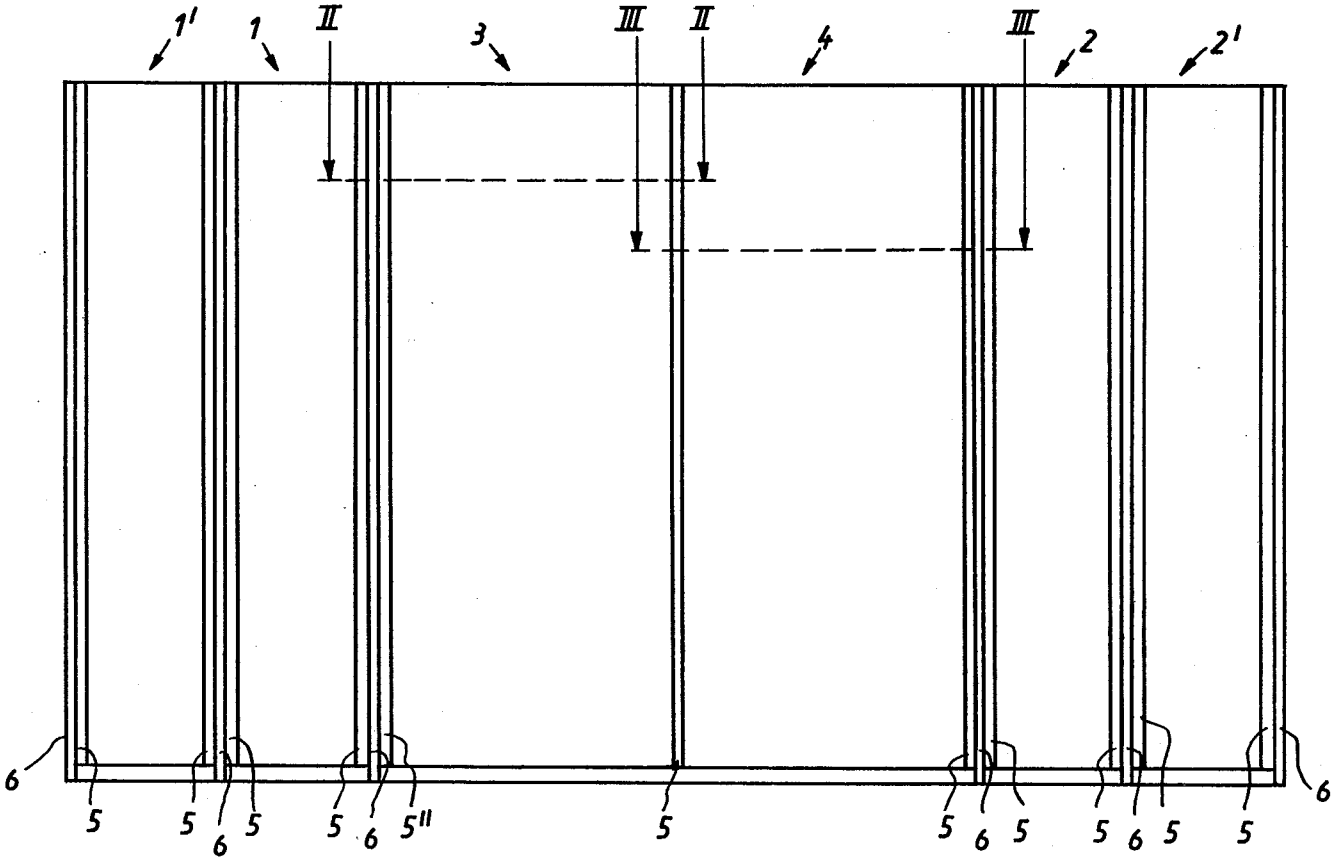
FIG. 1 is a front view of a furniture unit according to the invention.

The lefthand furniture unit shown as a front view in FIG. 1 is a cabinet combination comprising on the lefthand side and on the righthand side revolving or pivotal doors 1 and 1' and 2 and 2', respectively, as well as a pair of centrally arranged sliding doors 3 and 4. Each of the two revolving doors 1, 1', 2 and 2' as well as the outer sliding door 4 comprise handling bandings or ledges 5 at their two vertical longitudinal edges, and the inner sliding door 3 includes a similar handling banding or ledge 5'' at the lefthand vertical longitudinal edge thereof. The front edges of the vertical sidewalls of the cabinet unit are covered with profiled bands 6 having essentially T-shaped cross-section and being inserted with their web portions in longitudinally extending grooves of the front edges.

Figure 2:
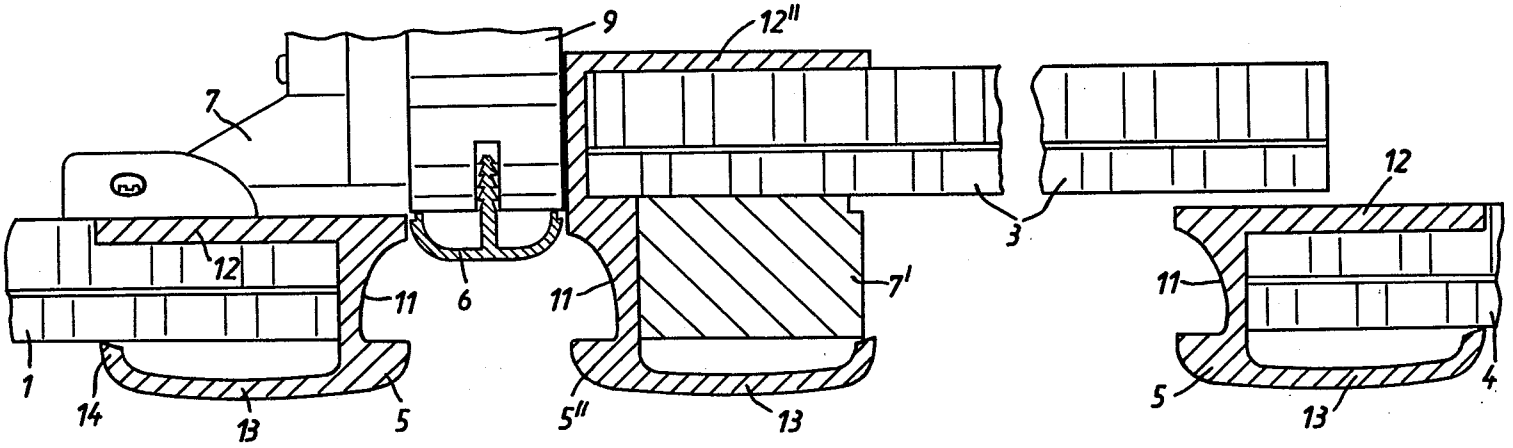
FIGS. 2 and 3 are fragmentary cross-sectional views at a larger scale than FIG. 1 along lines II—II and III—III, respectively.
Figure 3:
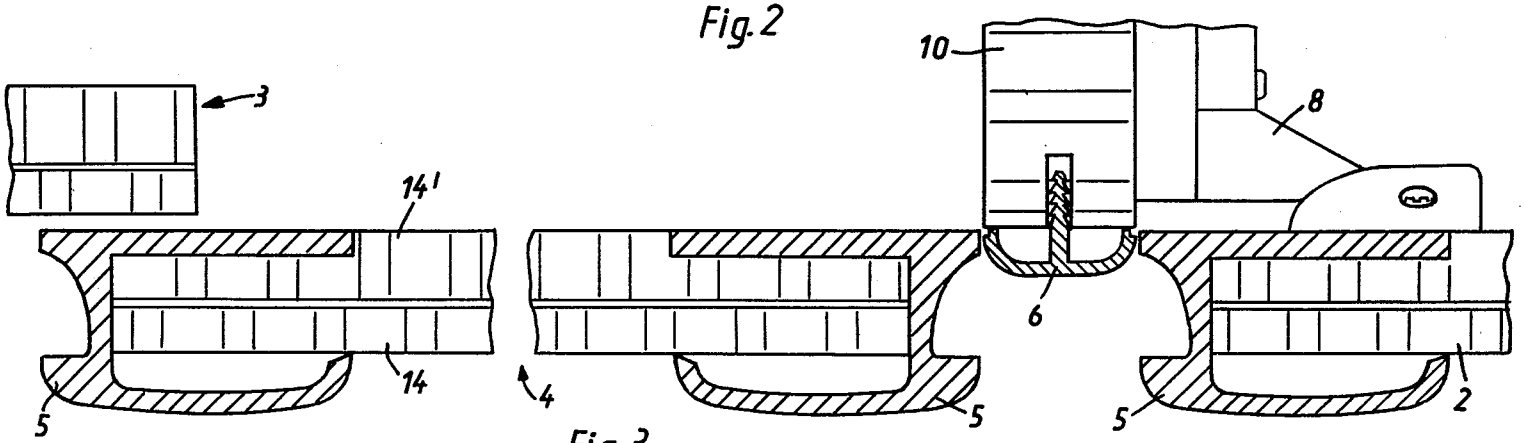

As is apparent from the FIGS. 2 and 3, the revolving or pivotal doors 1 and 2 are rotatably mounted by means of hinges 7 and 8 on the sidewalls 9 and 10. Preferably, the hinges 7 and 8 are designed as hinges of the double turning lever type in a manner known per se, so that they cause the doors 1 or 2 upon opening thereof from their closed position shown in the FIGS. 2 and 3 to be slidably moved away from the sidewalls 9 and 10, respectively, in addition to being pivoted, such that in the open position of the doors an undesirable collision of the edge of the handling banding 5 with the edge of the T-band 6 for the front edge will not occur. Therefore, in the open position the outer face of an outer U-leg 13 will assume a position which is somewhat laterally offset with respect to the adjacent inner wall of the sidewall 9 or 10, respectively. The sliding doors 3 and 4 are suspended from roller bearings, which have not been shown in the drawings as they are well known in the art; these roller suspensions enable the doors 3 and 4 to be moved independently of each other to right and left. As shown in the FIGS. 2 and 3, the hinges 7 and 8 project slightly beyond the associated handling banding; instead, they may also be made somewhat shorter so that they will not be visible from the front when transparent door panes are used.

As shown in FIG. 2, each handling strip 5 has essentially U-shaped cross-section, comprising a web portion 11, an inner U-leg 12 and an outer U-leg 13. The web portion 11 forms the finger groove and the inner longitudinal edge of the surface of the handling banding that includes the finger groove, together with one longitudinal edge of the crossbar of the adjacent T-band 6 covering the front edge, forms a substantially dust-tight termination in the closed condition of the doors. The outer U-leg of the handling banding 5 includes an inwardly directed extension 14.

The handling bandings of the revolving or pivotal doors 1, 1', 2, and 2' and of the outer sliding door 4 each are mounted on the two vertical longitudinal edges of the doors in such a manner that the web portion 11 rests on the respective front edge of each door. The U-legs 12 and 13 bear resiliently against the door portion disposed therebetween and thus tend to compensate for different door panel thicknesses. The handling banding 5'' of the inner sliding door 3 has a wider cross-section than the handling strips 5 and the U-legs 12'' and 13 thereof engage about both a compensating strip 7' and the lefthand marginal portion of the door 3, the finger groove of the banding 5'' being formed at the same level or depth as the finger grooves of the other bandings. Alternatively, the handling banding 5'' may be similar to the bandings 5 and disposed in such a manner that its inner U-leg and its web portion rest on the respective longitudinal edge of the front face of the door, provided suitable spacer means ensure that the finger groove is formed at the same level as the finger grooves of the other handling bandings.

As shown in FIG. 3, the door 4 comprises an ornamental panel 14 and a basic panel 14'; the front and rear face of the ornamental panel 14 are of different outer appearance, so that they may selectively be used as outwardly or inwardly facing outer surfaces of the cabinet door. The outer doors of the furniture unit are of similar design. In this way the purchaser of the furniture unit is offered a considerable number of different combinations of varying effect with regard to taste.

The externally visible combination of two handling bandings 5 with a front-edge T-band 6 results in a harmonious and symmetrical blending between adjacent cabinet cells, which may be either revolving door cabinet cells, sliding door cabinet cells, shelves or other types of cells. By the combination of a handling banding and a front edge T-band at the ends of the furniture unit, an aesthetically satisfying termination of the furniture unit is achieved. The handling bandings and the front-edge T-bands blend smoothly and mouldingly with the respective door panel and form a kind of relief. A box-like appearance of the furniture unit, which has been known up to the present, is thereby avoided. When the doors are closed, the handling bandings engage the respective front edge T-band in a substantially dust-tight manner, so that adjacent handling bandings and front edge T-bands form a graceful homogeneous whole smoothly merging into each other. Also, the bandings accentuate the vertical modular subdivision and provide for a uniform appearance of the vertical modular boundaries.

The front edge T-bands, the handling bandings and the outer faces of the doors may be matched to one another with different colours, such that a large number of attractive combinations is available.

The relatively small transverse dimension of the revolving door cell permits an adjustment of the entire length of the furniture unit, which also includes a couple of sliding doors, in such a manner that the unit extends relatively accurately from one wall of a room to the other.

Figure 4:
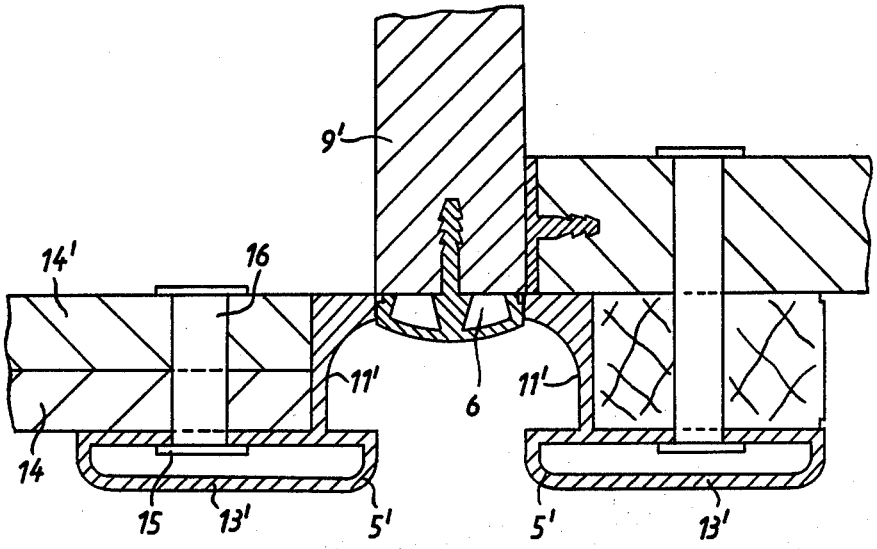
FIG. 4 is a sectional view similar to the lefthand part of FIG. 2, in which however another embodiment of the handling banding is shown.

In the embodiment shown in FIG. 4 the handling banding 5' is formed as an angle beam. The flange 11' of the angle beam forms the finger groove, and the other flange 13' is a hollow flange, in the interior of which an elongated bar 15 extends, which includes threaded bores for receiving fastening bolts 16 for securing the handling banding to the door panels 14 and 14'.

Figure 5:
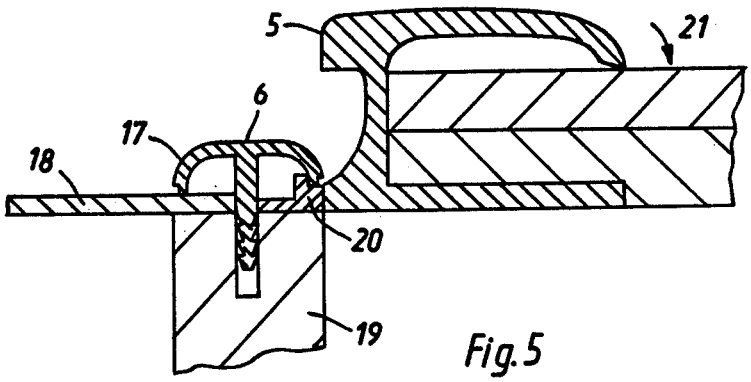
FIGS. 5 and 6 are sectional views of portions of the rear side of a furniture unit according to the invention.

In the aforedescribed embodiments, the crossbar of the front edge T-band 6 comprises flange extensions extending parallel to the longitudinal bar of the T, which flange extensions bear against the respective front edge. As shown in FIG. 5, such a front edge T-band is utilized to retain the rear panel 18 of a cabinet unit, the vertical longitudinal edge of the rear panel 18 being clamped between the front edge of the associated sidewall 19 and the one flange extension 17 of the T-band 6. Provided the second flange extension is not also utilized for retaining a panel, a compensating strip 20 is disposed below said second flange extension. Further, FIG. 5 shows a cabinet door 21 comprising a handling banding 5, which banding cooperates with the front edge T-band 6 and, respectively, with the compensating strip 20 in a dust-tight and aesthetically satisfying manner. Such a design for the rear side of a furniture unit is highly suitable for cabinets employed as room partitions, so that they may selectively be used from either side.

Figure 6:
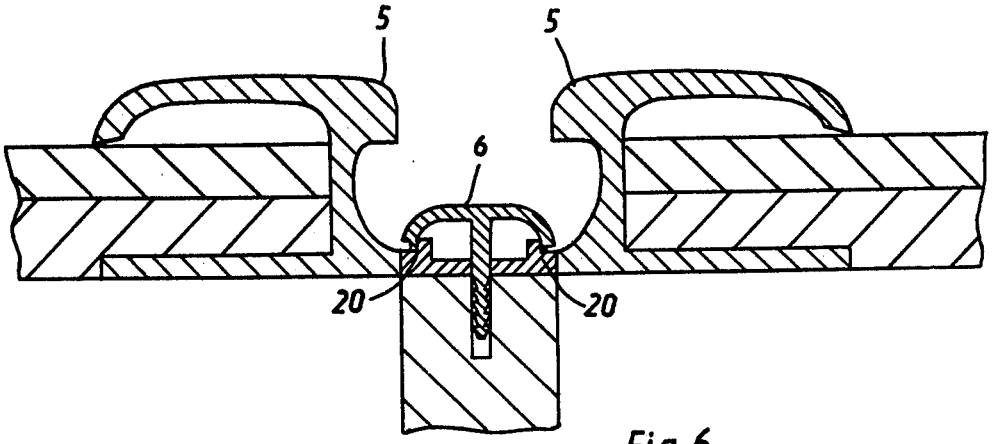

FIG. 6 shows a cross-section similar to FIG. 5 through a portion of a cabinet rear wall; however, compensating strips 20 are disposed on either side of the front edge T-band 6 since cabinet doors are mounted on either side thereof.

Figure 7:
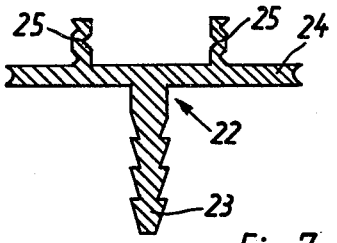
FIG. 7 is a cross-sectional view of a bottom strip, which is adapted to be mounted onto a front edge of a furniture unit according to the invention.

FIG. 7 shows a bottom strip having substantially T-shaped cross-section, which like the front edge T-band described in connection with the earlier embodiments includes a web portion 23 having longitudinal grooves forming barbs. On the side of the T-band 24 opposite to the web portion 23, corrugated longitudinal ribs 25 are formed, which serve as fastening means for receiving cover tringles 26 or 26' shown in FIGS. 8 and 9.

In this connection, the aforementioned corrugations on ribs 25 coact in latching engagement with corresponding corrugations on ribs 27 of cover tringle 26, as shown for instance in FIG. 8, or with the defining walls of the complementary slots in cover tringle 26' as illustrated for instance in FIG. 9.

In FIG. 8 the bottom strip 22 is mounted on the front edge of the cell sidewall 27' of a furniture unit, the web portion 23 engaging into a groove formed in the front edge. Onto the bottom strip 22 a cover tringle 26 made of metal or plastics has been mounted, which for locking engagement with the corrugated longitudinal ribs 25 is formed with complementary inner ribs 27. In the embodiment shown in FIG. 9, the cover tringle 26' is made of wood and includes corresponding longitudinally extending grooves which engage with the corrugated longitudinal ribs 25 of the bottom strip 22.

The front edge T-band shown in FIG. 1 also has two parts, and the bottom strip 22' is similar to the bottom strip 22 of FIG. 7 and is provided with similar longitudinally extending ribs 25'. The cover tringle 28 in the mounted state together with the bottom strip 22' defines a pair of laterally outwardly opening longitudinal channels 31 into which the panels 29 and 30 are inserted. The cover tringle 28 is made of plastic material or metal. The panels 29 and 30, which may form the rear walls of a furniture unit according to the invention, can readily be assembled by means of the bipartite front edge T-band.

FIG. 11 shows an embodiment similar to that shown in FIG. 10, in which, however, the strip 28' is formed with lateral longitudinally extending grooves 32, which serve the purpose of permitting snap engagement of an outer tringle 33.

The front edge T-bands shown in FIGS. 12 and 13 are tripartite and of a structure similar to that shown in FIG. 11. Between the bottom strip 22 and the cover tringle 35 there is disposed an intermediate strip 34 formed on one side thereof with a pair of ribs 36 for snap engagement between the ribs 25 of the bottom strip and on the opposite side having a pair of ribs 37 whereon the cover tringle 35 is secured by snap engagement of its inner ribs 38. The cover tringle 35 is made of metal or of plastic material.

The embodiment shown in FIG. 13 is similar to that of FIG. 12; however, the cover tringle 35' is made of wood and is provided with longitudinal grooves in its inner surface, said grooves engaging between the outer ribs 37' of the intermediate strip 34'.

The front edge T-bands shown in FIGS. 8 through 13 are particularly useful for panelled walls. The cover tringle 28 shown in FIG. 10 may be a punched bar in which shelves, umbrella stands, chest elements, or lighting fittings may be nested if desired.

The gripping bandings described hereinabove basically may be made of plastic material, or metal, or of wood.

The ornamental panels forming the door front faces may be provided with a wooden veneer, with a facing of plastic material or with a fabric covering. Instead of the ornamental panels mentioned above, plate glass panes and the like may also be used as door panels.

What is claimed is:

1. A cabinet-like furniture unit of cellular structure, comprising (a) cell walls separating the furniture cells from each other and having forwardly directed front edges;

(b) large-area door arrangements covering the forward open faces of said furniture cells, said door arrangements consisting of at least one pair of sliding doors and at least one pivotable door;

(c) handling ledges mounted at the edges of said doors;

(d) finger grooves provided in outer surfaces of said handling ledges and extending along the respective door edge and opening in a direction extending parallel to the main surface of the respective door and away from the respective door;

(e) profiled bands having substantially T-shaped cross-section and being inserted with their T-web portions into longitudinal grooves of said front edges of said cell walls for sheathing said front edges;

(f) said handling ledges and said profiled bands being arranged in such a manner that in the closed condition of the doors the inner longitudinal edge of said outer surface of each handling ledge is in close proximity to one longitudinal edge of the crossbar of the associated T-profiled band, whereby — viewed from the front — said handling ledge and said T-profiled band form a homogeneous whole.

2. A furniture unit as claimed in claim 1; in which all handling ledges mounted at the front of the furniture unit are of substantially identical design and are mounted at substantially the same depth of the furniture unit.

3. A furniture unit as claimed in claim 1; in which each said handling ledge is a resilient U-shaped clamping strip the web portion of which forms said finger groove and the inner U-leg of which forms a mounting flange.

4. A furniture unit as claimed in claim 3; in which the outer U-leg of said handling ledge includes an inwardly directed extension which bears resiliently against the front face of the door.

5. A furniture unit as claimed in claim 1; in which said handling ledge is an angle beam one flange of which forms said finger groove and the other flange of which is a mounting flange.

6. A furniture unit as claimed in claim 5; in which said mounting flange is hollow for receiving threaded fastening bolts.

7. A furniture unit as claimed in claim 1; in which the crossbar of said front edge T-band includes flange extensions extending generally parallel to the longitudinal bar of the T and bearing against the respective front edge.

* * * * *